United States Patent [19]

Richardson et al.

[11] Patent Number: 4,891,738

[45] Date of Patent: Jan. 2, 1990

[54] SELECTABLE APERTURE MODULE

[75] Inventors: Brian E. Richardson, San Jose; John R. Richardson, Los Gatos, both of Calif.

[73] Assignee: Morpheus Lights, Inc., San Jose, Calif.

[21] Appl. No.: 224,438

[22] Filed: Jul. 26, 1988

[51] Int. Cl.[4] ..... F21V 11/00

[52] U.S. Cl. ..... 362/282; 362/324; 362/284

[58] Field of Search ..... 362/277, 282, 322, 283, 362/284, 319, 324; 350/4.1, 311, 315, 318

[56] References Cited

U.S. PATENT DOCUMENTS

| | | | |
|---|---|---|---|
| 1,449,122 | 3/1923 | Marchand | 350/4.1 |
| 2,214,728 | 9/1940 | Gille et al. | 362/280 |
| 3,030,856 | 4/1962 | Jordan | 350/4.1 X |
| 4,082,464 | 4/1978 | Johnson, Jr. | 350/315 X |
| 4,110,581 | 8/1978 | Miunier | 350/315 X |
| 4,460,943 | 7/1984 | Callahan | 362/276 |

*Primary Examiner*—Stephen F. Husar
*Assistant Examiner*—Peggy Neils
*Attorney, Agent, or Firm*—Rosenblum, Parish & Bacigalupi

[57] ABSTRACT

A lighting system aperture mechanism formed by a movable carriage including a frame with openings for aperture means. The frame is moved to position a selected opening around a beam of light, and an aperture means disposed in the selected opening may be rotated as desired to produce special effect patterns in the beam of light.

7 Claims, 2 Drawing Sheets

OA
40
41
42f
42r
43f
44f
46f
46r
47f
47r
48f
48r
49f
141f
141r
142f
142r
143f
143r
144f
144r
145f
145r
146r
148
150
151
152
153
154
155
156
157
158
159
160
162
164
166
168
170

SELECTABLE APERTURE MODULE

BACKGROUND OF THE INVENTION

1. Field of the Invention

The present invention relates generally to optical aperture mechanisms and more particularly to a mechanism including multiple selectable and rotatable pattern apertures.

2. Discussion of the Prior Art

Conventional theatrical and display lighting systems have used various types of optical filters which are removably insertable into light beams to modify the distribution of light in the projected beam. U.S. Pat. No. 2,214,728 describes a color wheel which includes several optical filters and which is rotatable to position a selected filter across a beam of light. The several filters have equal areas with uniformly dense coloring and do not produce different shapes in the projected beam of light.

U.S. Pat. No. 1,449,122 describes a kaleidoscope projector including several hollow tubes that are lined with different numbers of mirrors and supported in a frame which is rotatable to position a selected tube around light in a beam along an optical axis. Tube rotation gears are used to turn the selected tube of mirrors to spin the kaleidoscopic beam around the optical axis. However, the rotatable mirror tubes cannot stencil patterns into the beam, which requires a pattern aperture in a focal plane of the projector. The beam of light may be conventionally patterned by a strip of film scrolled across the beam between opposite side spools.

U.S. Pat. No. 3,030,856 describes a kaleidoscope projector which forms variable apertures using a pair of main disks each supporting a plurality of smaller disks around its periphery. Each smaller disk has translucent apertures spaced regularly around its own periphery. The main disks and each of the smaller disks are simultaneously rotated to continuously, and practically uncontrollably, vary the effective aperture shape and the pattern of light in the beam projected from the kaleidoscope.

U.S. Pat. No. 4,232,359 describes an illumination system including a plurality of shutters having edges or patterns of desired shapes, one or more of which may be manually inserted into, and remain fixed at a respective location in, a beam of light.

U.S. Pat. No. 4,460,943 describes a light projector including a disc which has a number of openings for mounting "gobos" (stencils for light) and which is rotatable to insert a selected gobo into the focal plane of a beam of light.

However, none of the above prior art lighting systems provides multiple selectable and automatically positionable apertures together with means for rotating the selected aperture around the axis of a beam to controllably vary the projected pattern of light.

SUMMARY OF THE PRESENT INVENTION

It is therefore a primary objective of the present invention to provide an aperture apparatus including multiple pattern aperture means which are selectively and automatically positionable and rotatable around an optical axis.

Another objective is to provide a unitary and flexibly operable aperture apparatus for performing functions previously requiring separate aperture apparatuses.

Briefly, a preferred embodiment of the invention is formed from base means, carriage means including frame means which has multiple openings and which is movably supported on said base means, multiple pattern aperture means formed by aperture plates and aperture holders rotatably engaged adjacent respective ones of said openings, frame drive means for selectively moving said frame means to center a selected opening around an optical axis, and aperture drive means for spinning a pattern aperture means centered on the optical axis.

The present invention has the advantage that a selected pattern aperture means can be spun, in a desired direction at a desired speed, to produce special effect patterns in a beam of light projected therethrough.

These and other objects of the present invention will become apparent to those skilled in the art upon reading the following detailed description of the preferred embodiment as shown in the accompanying drawing figures.

DETAILED DESCRIPTION OF THE PREFERRED EMBODIMENT

Figure 1:
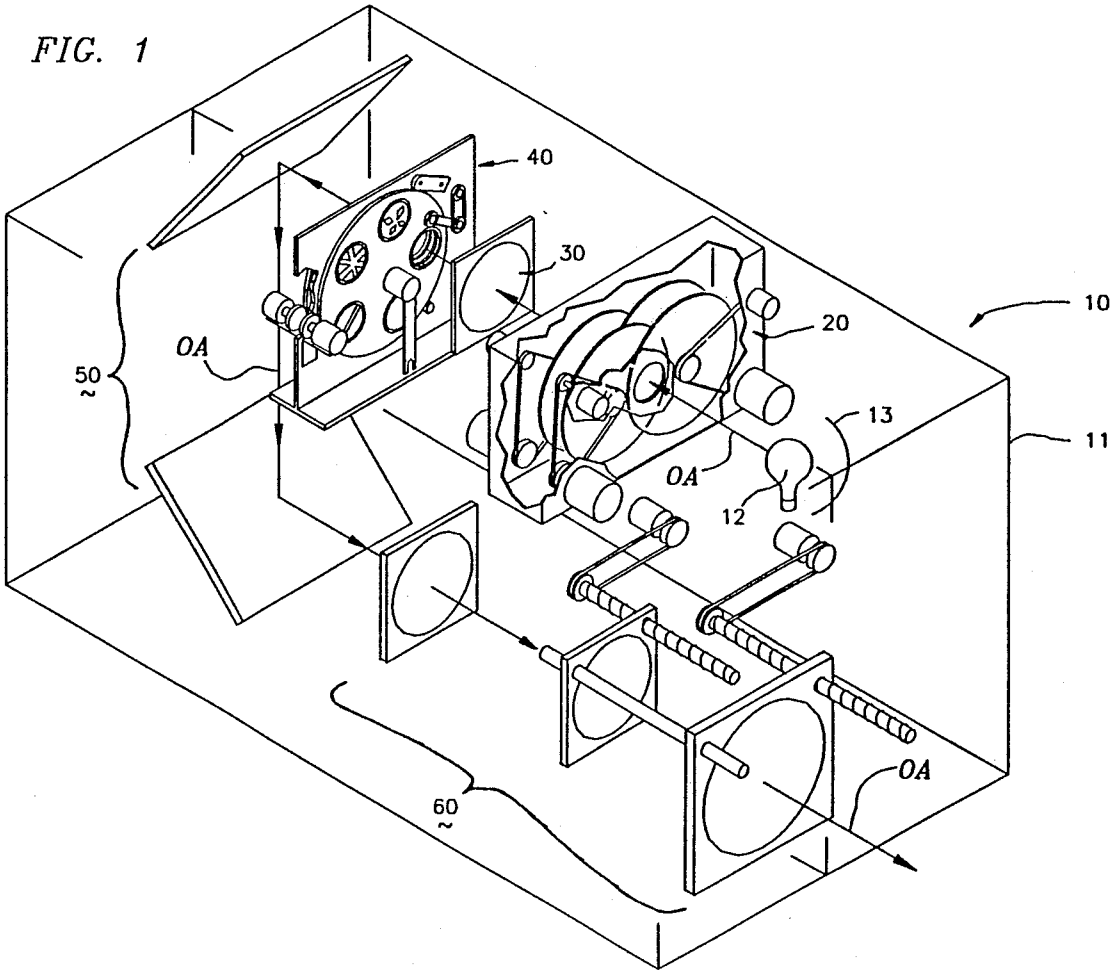
FIG. 1 is an isometric view of a lighting system including a preferred embodiment of a selectable aperture module according to the present invention.

The present invention is preferably embodied in a selectable aperture module 40 which may be used in the context of a spot light projection system 10 as illustrated in FIG. 1. System 10 is mounted within a (schematically outlined) housing 11 and includes a light source such as a short arc lamp 12 with a parabolic reflector 13 which radiates light around optical axis OA (leftward in FIG. 1). The radiated light is conventionally filtered through a "hot filter" (not shown) which removes infra-red and ultra-violet light while passing visible light. The visible light in a beam is preferably passed through a spectral filtering module 20 which controls its color and intensity as disclosed in Applicant's co-pending application ser. no. 224,436 filed 07/26/88.

Downstream from filtering module 20, the filtered light beam is preferably diffused through an acid-etched glass plate diffusor (not shown). The optionally filtered and diffused light beam is then passed through a condenser lens 30 which focuses the beam downstream towards selectable aperture module 40.

Aperture module 40 holds multiple apertures in one or more planes normal to axis OA at or near a focal point of lens system 60. A selected aperture is positioned to be intersected by the beam of light as described below.

Between various elements of system 10 the light beam may be reflected by one or mirrors in a beam folding means 50 to minimize the size of the housing 11. Downstream from aperture module 40 the patterned beam of light traverses zoom lens system 60, whereby the beam is focused and projected from system 10 as further described in Applicant's co-pending application ser. no.

224,436 filed 07/26/88. The beam axis may be directed as desired by vertically tilting and/or horizontally panning housing 11.

Figures 2, 3, 4, 5:
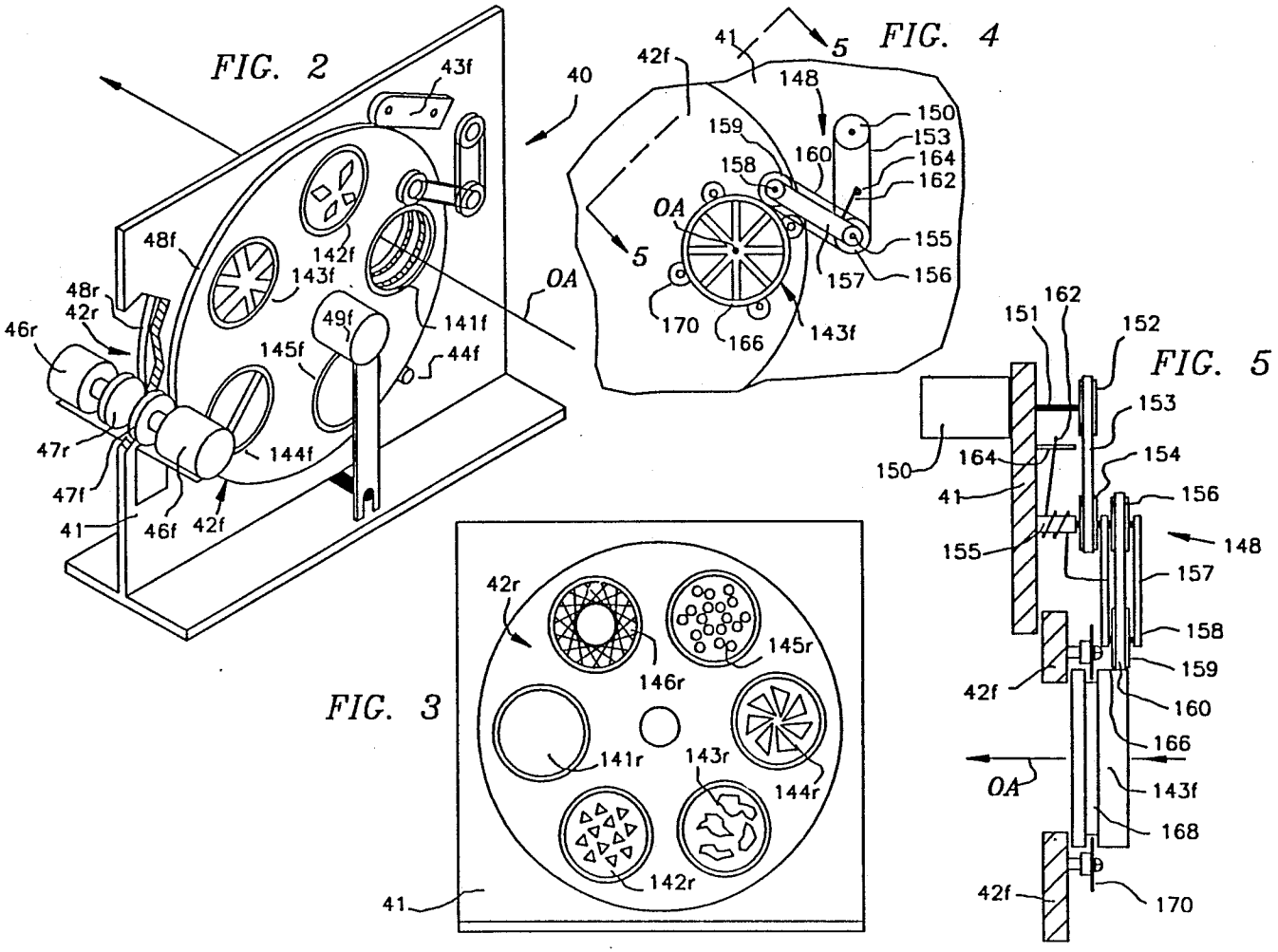
FIG. 2 is an isometric view of the selectable aperture module of FIG. 1.
FIG. 3 is a rear view of a FIG. 2 frame wheel engaging example pattern aperture means.
FIG. 4 is a front view of the FIG. 2 aperture drive mechanism.
FIG. 5 is a cross-sectional view taken along line 5—5 through the FIG. 4 aperture drive mechanism and, for the sake of clarity, omitting the rear frame wheel.

Referring to FIG. 2, selectable aperture module 40 includes a base panel 41, carriage means including a first or front frame or carousel wheel 42F and preferably a second or rear frame or carousel wheel 42R. Spring-loaded guide rollers (43F) in the front and (not shown) in the rear urge frame wheels 42F and 42R against fixed guide rollers (44F) in the front and (not shown) in the rear. Frame drive motors 46F and 46R, which may be analog DC servo motors or digital AC stepper motors, turn drive rollers 47F and 47R whose friction against rims 48F and 48R turns wheels 42F and 42R. Analog servo motor operations cause wheel movements which are preferably sensed by axially-connected potentiometers (49F) in the front and (not shown) in the rear.

Front wheel 42F has, equally spaced in five sectors, one circular opening 141F which is left empty for entirely passing a beam of light and four circular openings which are used to engage aperture holders of aperture means 142F through 145F including pattern aperture plates for patterning the beam of light.

Referring to FIG. 3, rear wheel 42R has, equally spaced in six sectors, one circular opening 141R which is left empty and five circular openings which are used to engage aperture holders of aperture means 142R through 146R.

FIGS. 4 and 5 show front wheel 42F in a different rotational position where pattern aperture means 143F is intersected by light in a beam around axis OA. Frame wheel 42F is provided with a holder drive mechanism 148 comprising a motor 150 with a shaft 151 attached to a pulley 152 which engages a belt 153 looped around a pulley 154. A fixed sleeve 155 has a hollow core containing bearings supporting a rotatable shaft which is attached between pulley 154 and a pulley 156. Sleeve 155 is pivotally connected to one end of a rigid link 157 which has its other end pivotally connected to a sleeve 158, similarly containing bearings and a rotatable shaft which is in turn attached to a pulley 159. Pulleys 156 and 159 are encircled by a belt 160. A spring 162 is disposed around sleeve 155 with one end compressed against a stop peg 164 and the other end compressed against link 157. Spring 162 acts through link 157, sleeve 158 and pulley 159 to force belt 160 against rim 166 of holder 143F. Aperture holder rim 166, for example, has a groove 168 guided by washers on pins 170.

In operation, frame drive motors 46F and/or 46R are selectively operated in either direction at selected speed(s) to move frames 42F and/or 42R to desired positions. Analog DC servo-motors are preferably controlled by analog or appropriately converted digital signals fed back from potentiometers or encoders 49. Drive motor 46 operations may optionally be further controlled by a programmed microprocessor (not shown).

When frame wheel 42F is positioned with selected aperture means (143F for example) centered on optical axis OA the selected front aperture holder may be spun by holder drive mechanism 148. Motor 150 is selectively operated in either direction at a selected speed to turn belt 160 against rim 166 of the aperture holder and spin the pattern aperture plate intersected by the beam of light around axis OA.

Although the present invention has been described in a preferred embodiment, it will be appreciated by those skilled in the art that this embodiment may be modified without departing from the essence of the invention. For example the carriage means may include a straight frame which is linearly slidable across the axis of a beam, or a paddle-wheel type frame which is rotatable to position a selected paddle with an aperture holder across the axis of a beam. It is therefore intended that the following claims be interpreted as covering any modifications falling within the true scope and spirit of the invention.

We claim:

1. Selectable aperture apparatus for use across a beam of light projected in a spotlight, comprising:

a base;

carriage means movably suspended on said base and having a surface defining a first plurality of openings;

a second no greater plurality of pattern aperture means having circular rims, disposed co-axially and rotatably adjacent respective ones of said openings;

carriage drive means supported by said base for controllably positioning said carriage means so that a selected one of said openings is co-axially intersected by the optical axis of said beam of light; and aperture drive means for controllably spinning a pattern aperture means disposed adjacent an opening then intersected by said optical axis to spin the apparent pattern of light in said beam.

2. Apparatus as in claim 1 wherein said carriage means comprises carousel wheel means rotatably suspended on said base means.

3. Apparatus as in claim 2 wherein said carousel wheel means comprises two coaxially parallel supported wheels.

4. Apparatus as in claim 1 wherein said aperture drive means comprises a motor supported by said base for applying drive forces to spin the rim of an aperture means disposed adjacent an opening then centered on said optical axis.

5. Apparatus as in claim 1 wherein said carousel drive means comprises an analog servo motor and sensor means which senses operations of said motor and responsively feeds back signals to control said motor means.

6. Apparatus as in claim 1 wherein one or both of said carousel and aperture drive means comprises a digital step-rotative motor means.

7. Apparatus as in claim 6 wherein said step-rotative motor means comprises an encoder which senses operations of said rotative motor and responsively feeds back digital signals to control said rotative motor.

* * * * *